US009620056B2

(12) United States Patent
Yang et al.

(10) Patent No.: US 9,620,056 B2
(45) Date of Patent: Apr. 11, 2017

(54) PIXEL AND ORGANIC LIGHT EMITTING DISPLAY USING THE SAME

(71) Applicants: Jin-Wook Yang, Yongin (KR); Bon-Seog Gu, Yongin (KR); Woo-Seok Han, Yongin (KR)

(72) Inventors: Jin-Wook Yang, Yongin (KR); Bon-Seog Gu, Yongin (KR); Woo-Seok Han, Yongin (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 331 days.

(21) Appl. No.: 13/891,418

(22) Filed: May 10, 2013

(65) Prior Publication Data

US 2014/0168290 A1 Jun. 19, 2014

(30) Foreign Application Priority Data

Dec. 18, 2012 (KR) ..... 10-2012-0148227

(51) Int. Cl.
*G09G 3/32* (2016.01)
*G09G 3/3233* (2016.01)
*G09G 3/3291* (2016.01)

(52) U.S. Cl.
CPC ..... *G09G 3/3233* (2013.01); *G09G 3/3291* (2013.01); *G09G 2300/0819* (2013.01); *G09G 2320/045* (2013.01)

(58) Field of Classification Search
CPC ..... G09G 3/3208
See application file for complete search history.

(56) References Cited

U.S. PATENT DOCUMENTS

2007/0024541 A1* 2/2007 Ryu et al. ..... 345/76
2007/0024543 A1* 2/2007 Chung ..... G09G 3/3233 345/76
2007/0085781 A1* 4/2007 Chung et al. ..... 345/76
2007/0215888 A1* 9/2007 Mitsuhashi ..... G09G 3/3225 257/94
2008/0036710 A1* 2/2008 Kim ..... G09G 3/3233 345/82
2008/0048560 A1 2/2008 Sung et al.
2009/0027423 A1* 1/2009 Kwon ..... 345/690
2010/0188320 A1 7/2010 Min et al.
(Continued)

FOREIGN PATENT DOCUMENTS

KR 10-2008-0018557 A 2/2008
KR 10-2010-0086877 A 8/2010
KR 10-2011-0104705 A 9/2011

*Primary Examiner* — Michael Faragalla
*Assistant Examiner* — Chayce Bibbee
(74) *Attorney, Agent, or Firm* — Lee & Morse P.C.

(57) ABSTRACT

A pixel includes an organic light emitting diode (OLED), a first transistor for controlling an amount of current that flows from a first power supply to a second power supply via the OLED to correspond to a voltage applied to a first node, a second transistor coupled between an anode electrode of the OLED and a feedback line, and having a gate electrode coupled to a control line, a third transistor coupled between the first node and a data line, and having a gate electrode coupled to a first scan line, a storage capacitor coupled between the first node and a second node, and a fourth transistor coupled between the second node and a reference power supply, and having a gate electrode coupled to a second scan line.

18 Claims, 6 Drawing Sheets

(56) References Cited

U.S. PATENT DOCUMENTS

| | | | | |
|---|---|---|---|---|
| 2010/0220038 | A1* | 9/2010 | Chung et al. | 345/76 |
| 2011/0227505 | A1* | 9/2011 | Park | H05B 33/0896 315/297 |

* cited by examiner

PIXEL AND ORGANIC LIGHT EMITTING DISPLAY USING THE SAME

CROSS-REFERENCE TO RELATED APPLICATION

This application claims priority to and the benefit of Korean Patent Application No. 10-2012-0148227, filed on Dec. 18, 2012, in the Korean Intellectual Property Office, the entire content of which is incorporated herein by reference.

BACKGROUND

1. Field

Embodiments relate to a pixel and an organic light emitting display using the same, and more particularly, to a pixel capable of displaying an image with uniform brightness and an organic light emitting display using the same.

2. Description of the Related Art

Recently, various flat panel displays (FPD) capable of reducing weight and volume that are disadvantages of cathode ray tubes (CRT) have been developed. The FPDs include liquid crystal displays (LCD), field emission displays (FED), plasma display panels (PDP), and organic light emitting displays.

Among the FPDs, the organic light emitting displays display images using organic light emitting diodes (OLED) that generate light by re-combination of electrons and holes. The organic light emitting display has high response speed and is driven with low power consumption.

The organic light emitting display includes a plurality of pixels arranged at intersections of a plurality of data lines, scan lines, and power supply lines in a matrix. Each of the pixels commonly includes an organic light emitting diode (OLED) and a driving transistor for controlling the amount of current that flows to the OLED. The pixels supply currents from the driving transistors to the OLEDs to correspond to data signals to generate light components with predetermined brightness components.

However, as illustrated in FIG. 1, when a white gray scale is displayed after realizing a black gray scale in a conventional pixel, light with lower brightness than desired brightness is generated in a period of about two frames. In this case, an image with desired brightness is not displayed by the pixels to correspond to the gray scales. Therefore, uniformity of brightness is deteriorated so that picture quality of a moving picture is deteriorated.

As a result of experiment, in the organic light emitting display, deterioration of a response characteristic is caused by the characteristic of the driving transistor included in the pixel. That is, the threshold voltage of the driving transistor is shifted to correspond to the voltage applied to the driving transistor in a previous frame period so that light with desired brightness is not generated in the current frame.

In addition, in the conventional organic light emitting display, the OLED is deteriorated to correspond to use time. When the OLED is deteriorated, due to a change in efficiency, an image with desired brightness is not displayed. With the lapse of time, the OLED is deteriorated so that light with low brightness is generated to correspond to the same data signal.

SUMMARY

Accordingly, embodiments are directed to providing a pixel capable of displaying an image with uniform brightness and an organic light emitting display using the same.

One or more embodiments provides a pixel, including an organic light emitting diode (OLED), a first transistor for controlling an amount of current that flows from a first power supply to a second power supply via the OLED to correspond to a voltage applied to a first node, a second transistor coupled between an anode electrode of the OLED and a feedback line, and having a gate electrode coupled to a control line, a third transistor coupled between the first node and a data line, and having a gate electrode coupled to a first scan line, a storage capacitor coupled between the first node and a second node, and a fourth transistor coupled between the second node and a reference power supply, and having a gate electrode coupled to a second scan line.

The third transistor may be turned on and off at least once in a partial period of a period in which the fourth transistor is turned on. The second transistor may be turned on so that a turn-on period thereof overlaps that of the fourth transistor in a specific frame period of a plurality of frames. The turn-on period of the second transistor may not overlap that of the third transistor.

The pixel may further include a fifth transistor coupled between the first power supply and the second node, and having a gate electrode coupled to an emission control line, and a sixth transistor coupled between a common terminal of the second transistor and the first transistor and the anode electrode of the OLED, and having a gate electrode coupled to the emission control line. A turn-on period of the fifth transistor may not overlap that of the fourth transistor in a remaining frame period excluding a frame in which deterioration information of the OLED is extracted among a plurality of frames.

The pixel may further include a fifth transistor coupled between the first power supply and the second node, and having a gate electrode coupled to an emission control line, and a sixth transistor coupled between a common terminal of the second transistor and the anode electrode of the OLED and the first transistor, and having a gate electrode coupled to the emission control line. A turn-on period of the fifth transistor may not overlap that of the fourth transistor in a remaining frame period excluding a frame in which threshold voltage information of the first transistor is extracted among a plurality of frames.

One or more embodiments provides an organic light emitting display, including a scan driver for driving first scan lines, second scan lines, and emission control lines, a control line driver for driving control lines, a data driver for driving data lines, pixels positioned at intersections of the first scan lines and the data lines, a sensing unit for extracting deterioration information of OLEDs included in the pixels in a first frame period of a plurality of frames and for extracting threshold voltage information of driving transistors included in the pixels in a second frame period, a timing controller for changing bits of first data items to correspond to the deterioration information and the threshold voltage information to generate second data items, and a data driver for supplying off data signals to the data lines in the first frame period, for supplying sensing data signals to the data lines in the second frame period, and for supplying data signals corresponding to the second data items to the data lines in remaining frames excluding the first frame period and the second frame period.

The sensing data signals may be set so that predetermined currents may flow from the driving transistors. The off data signals may be set so that the driving transistors may be turned off. The sensing unit may supply predetermined current to the feedback line in the first frame period to extract the deterioration information of the OLEDs and to extract the threshold voltage information of the driving transistors to correspond to amounts of currents supplied from the pixels to correspond to the sensing data signals in the second frame period.

Each of the pixels positioned in an ith horizontal line may include an OLED, a driving transistor for controlling an amount of current that flows from a first power supply to a second power supply via the OLED to correspond to a voltage applied to a first node, a second transistor coupled between an anode electrode of the OLED and a feedback line, and turned on when a control signal is supplied to an ith control line, a third transistor coupled between the first node and a data line, and turned on when a first scan signal is supplied to an ith first scan line, a storage capacitor coupled between the first node and a second node, and a fourth transistor coupled between the second node and a reference power supply, and turned on when a second scan signal is supplied to an ith second scan line.

The scan driver may supply a second scan signal to an ith second scan line to overlap a first scan signal supplied to an ith first scan line and to have a larger width than the first scan signal. The control line driver may supply a control signal to an ith control line to overlap the second scan signal supplied to the ith second scan line in the first frame period and the second frame period. The first scan signal supplied to the ith first scan line may not overlap the control signal supplied to the ith control line.

Each of the pixels positioned in the ith horizontal line may further include a fifth transistor coupled between the first power supply and the second node, and turned off when an emission control signal is supplied to an ith emission control line and otherwise turned on, and a sixth transistor coupled between a common terminal of the second transistor and the driving transistor and the anode electrode of the OLED, and simultaneously turned on and off with the fifth transistor. The scan driver may supply an emission control signal to an ith emission control line to overlap the second scan signal supplied to the ith second scan line in a remaining period excluding the first frame period.

Each of the pixels positioned in the ith horizontal line may further include a fifth transistor coupled between the first power supply and the second node, and turned off when an emission control signal is supplied to an ith emission control line and otherwise turned on, and a sixth transistor coupled between a common terminal of the second transistor and the anode electrode of the OLED and the driving transistor, and simultaneously turned on and off with the fifth transistor. The scan driver may supply an emission control signal to an ith emission control line to overlap the second scan signal supplied to the ith second scan line in a remaining period excluding the second frame period.

DETAILED DESCRIPTION

Korean Patent Application No. 10-2012-0148227, filed on Dec. 18, 2012, in the Korean Intellectual Property Office, and entitled: "Pixel and Organic Light Emitting Display Device Using the same" is incorporated by reference herein in its entirety.

Hereinafter, a pixel and an organic light emitting display using the same will be described in detail as follows with reference to FIGS. 2 to 9 in which preferred embodiments by which those who skilled in the art may easily perform the same are included.

Figure 1:
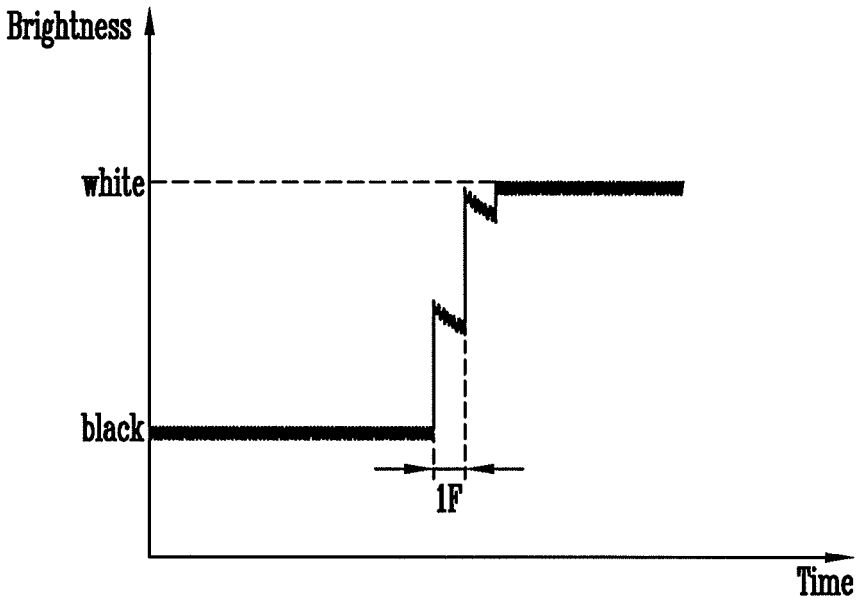
FIG. 1 is a view illustrating deviation in brightness components corresponding to gray scales.
Figure 2:
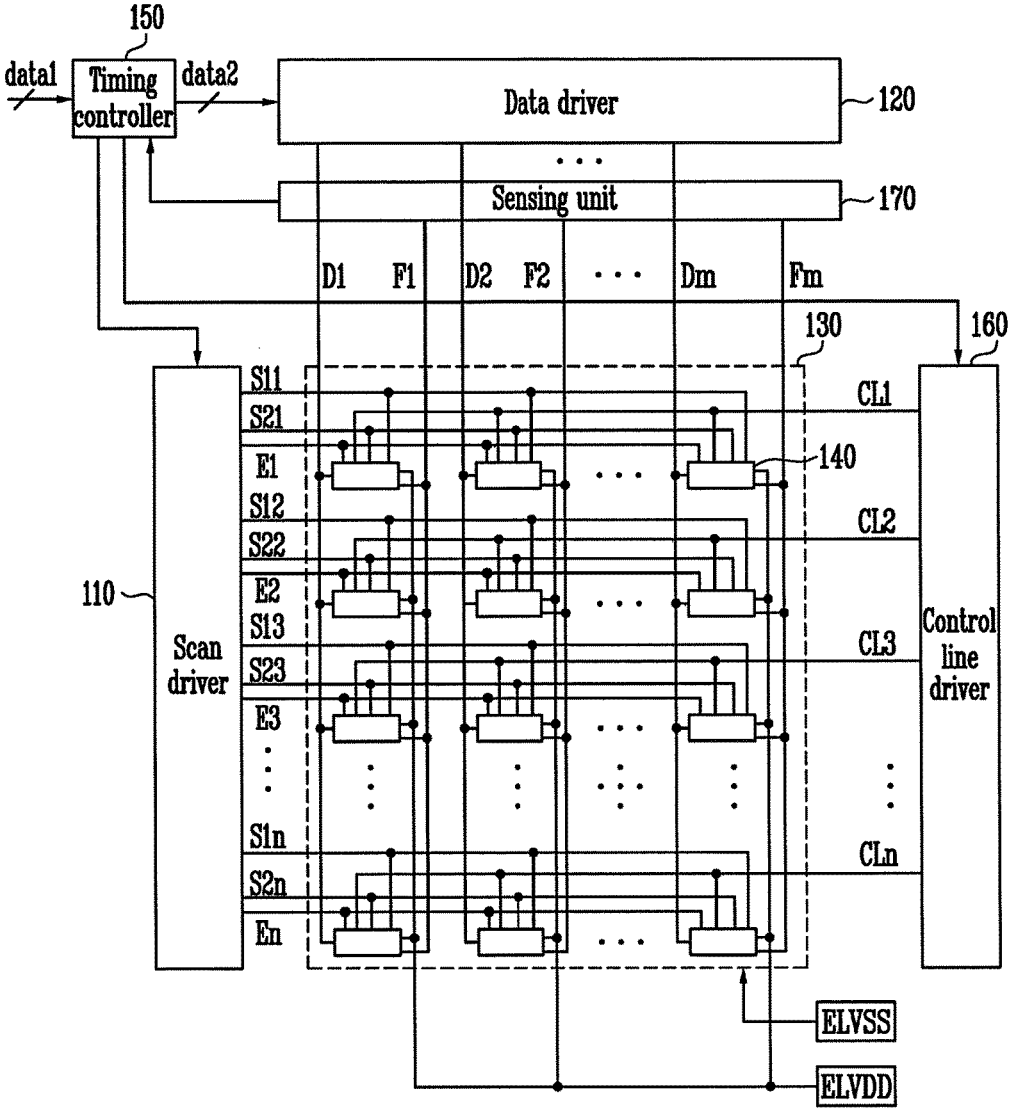
FIG. 2 is a view illustrating an organic light emitting display according to an embodiment.

FIG. 2 is a view illustrating an organic light emitting display according to an embodiment. Referring to FIG. 2, the organic light emitting display according to the present embodiment includes a pixel unit 130 having pixels 140 positioned at intersections of first scan lines S11 to S1*n*, second scan lines S21 to S2*n*, and data lines D1 to Dm, a scan driver 110 for driving the first scan lines S11 to S1*n*, the second scan lines S21 to S2*n*, and emission control lines E1 to En, a data driver 120 for driving the data lines D1 to Dm, a control line driver 160 for driving control lines CL1 to CLn, and a timing controller 150 for controlling the scan driver 110, the data driver 120, and the control line driver 160.

In addition, the organic light emitting display according to the present embodiment further includes a sensing unit 170 for extracting deterioration information of organic light emitting diodes (OLED) included in the pixels 140 and threshold voltage information of driving transistors included in the pixels 140 using feedback lines F1 to Fm.

The pixel unit 130 includes the pixels 140 positioned at the intersections of the first scan lines S11 to S1*n*, the second scan lines S21 to S2*n*, and the data lines D1 to Dm. During a sensing period, the pixels 140 transmit the deterioration information of the OLEDs and/or the threshold voltage information of the driving transistors to the feedback lines F1 to Fm and receive corrected data signals to correspond to the deterioration information and/or the threshold voltage information to the feedback lines F1 to Fm. The pixels 140 that receive the data signals control the amounts of currents supplied from a first power supply ELVDD to a second power supply ELVSS via OLEDs (see FIGS. 3 and 7) to generate light components with predetermined brightness components.

The scan driver 110 supplies a first scan signal to the first scan lines S11 to S1*n* and supplies a second control signal to the second scan lines S21 to S2*n*. The scan driver 110 supplies emission control signals to the emission control lines E1 to En. Here, the first scan signal and the second scan signal are set to have voltages (for example, low voltages) at which transistors may be turned on and the emission control signals are set to have voltages (for example, high voltages) at which the transistors may be turned off. The supply types of the first scan signal, the second scan signal, and the emission control signals will be described in detail later.

The control line driver 160 supplies control signals to the control lines CL1 to CLn in the sensing period. For example, the control line driver 160 may sequentially supply the control signals to the control lines CL1 to CLn in a first sensing period for extracting the deterioration information and a second sensing period for extracting the threshold voltage information.

The data driver 120 receives second data data2 in a driving period and generates data signals using the received second data data2. The data signals generated by the data driver 120 are supplied to the data lines D1 to Dm in synchronization with scan signals. In addition, the data driver 120 supplies off data signals to the data lines D1 to Dm so that the driving transistors included in the pixels 140 may be turned off in the first sensing period and supplies sensing data signals to the data lines D1 to Dm so that predetermined currents may flow from the driving transistors included in the pixels 140 in the second sensing period, as will be described in detail later.

The sensing unit 170 extracts the deterioration information of the OLEDs included in the pixels 140 in the first sensing period and extracts the threshold voltage information of the driving transistors included in the pixels 140 in the second sensing period. For example, the sensing unit 170 supplies predetermined currents to the pixels 140 in the first sensing period and may extract the deterioration information using the voltages applied to the OLEDs to correspond to the supplied currents. In addition, the sensing unit 170 may extract the threshold voltage information of the driving transistors to correspond to the amounts of currents supplied from the pixels 140 to correspond to the sensing data signals in the second sensing period. The deterioration information and the threshold voltage information extracted by the sensing unit 170 are transmitted to the timing controller 150. The sensing unit 170 for compensating for the deterioration of the OLEDs and the threshold voltages of the driving transistors outside the pixels 140 may be realized by variety of currently known circuits.

The timing controller 150 controls the scan driver 110, the data driver 120, and the control line driver 160. In addition, the timing controller 150 changes first data data1 to correspond to the deterioration information and/or the threshold voltage information supplied from the sensing unit 170 to generate second data data2. Here, the second data data2 is set so that the deterioration of the OLEDs included in the pixels 140 and the threshold voltages of the driving transistors included in the pixels 140 may be compensated.

Figure 3:
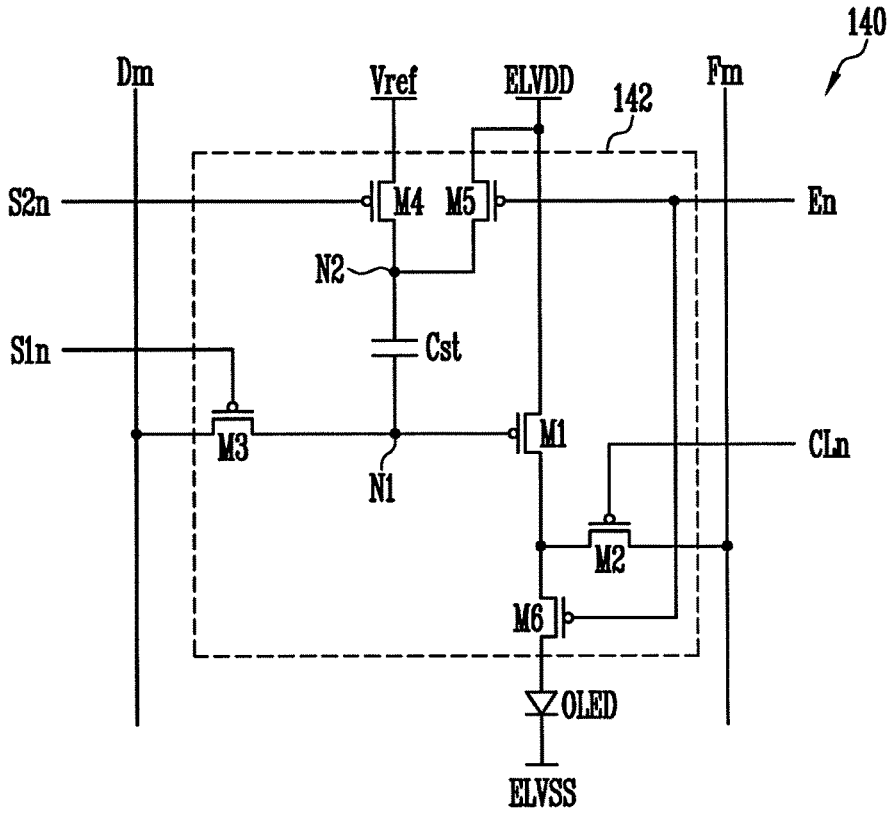
FIG. 3 is a view illustrating a pixel according to a first embodiment.

FIG. 3 is a view illustrating a pixel according to a first embodiment. In FIG. 3, for convenience sake, the pixel coupled to the mth data line Dm and the nth first scan line S1*n* will be illustrated. Referring to FIG. 3, the pixel 140 according to the first embodiment includes an OLED and a pixel circuit 142 for controlling the amount of current supplied to the OLED.

An anode electrode of the OLED is coupled to the pixel circuit 142 and a cathode electrode of the OLED is coupled to the second power supply ELVSS. The OLED generates light with predetermined brightness to correspond to the current supplied from the pixel circuit 142.

The pixel circuit 142 controls the amount of current supplied to the OLED to correspond to a data signal. For this purpose, the pixel circuit 142 includes first to sixth transistors M1 to M6 and a storage capacitor Cst.

A first electrode of the first transistor M1 is coupled to the first power supply ELVDD and a second electrode of the first transistor M1 is coupled to a first electrode of the sixth transistor M6. A gate electrode of the first transistor M1 is coupled to a first node N1. The first transistor M1 controls the amount of current supplied from the first power supply ELVDD to the second power supply ELVSS via the OLED to correspond to the voltage applied to the first node N1.

A first electrode of the second transistor M2 is coupled to the second electrode of the first transistor M1 and the second electrode of the second transistor M2 is coupled to the feedback line Fm. A gate electrode of the second transistor M2 is coupled to the control line CLn. The second transistor M2 is turned on when the control signal is supplied to the control line CLn to electrically couple the feedback line Fm and the second electrode of the first transistor M1 to each other.

A first electrode of the third transistor M3 is coupled to the data line Dm and a second electrode of the third transistor M3 is coupled to the first node N1. A gate electrode of the third transistor M3 is coupled to the first scan line S1*n*. The third transistor M3 is turned on when the first scan signal is supplied to the first scan line Sin to electrically couple the data line Dm and the first node N1 to each other.

A first electrode of the fourth transistor M4 is coupled to the reference power supply Vref and a second electrode of the fourth transistor M4 is coupled to the second node N2. A gate electrode of the fourth transistor M4 is coupled to the second scan line S2*n*. The fourth transistor M4 is turned on when the second scan signal is supplied to the second scan line S2*n* to supply the voltage of the reference power supply Vref to a second node N2.

A first electrode of the fifth transistor M5 is coupled to the first power supply ELVDD and a second electrode of the fifth transistor M5 is coupled to the second node N2. A gate electrode of the fifth transistor M5 is coupled to the emission control line En. The fifth transistor M5 is turned off when the emission control signal is supplied to the emission control line En and is otherwise turned on.

The first electrode of the sixth transistor M6 is coupled to a common terminal of the first transistor M1 and the second transistor M2 and a second electrode of the sixth transistor M6 is coupled to the anode electrode of the OLED. A gate electrode of the sixth transistor M6 is coupled to the emission control line En. The sixth transistor M6 is turned off when the emission control signal is supplied to the emission control line En and is otherwise turned on.

The storage capacitor Cst is coupled between the first node N1 and the second node N2. The storage capacitor Cst charges the voltage corresponding to a difference between the data signal and the reference power supply Vref. Here, voltage drop is not generated in the reference power supply Vref that does not supply current to the pixel. Therefore, a desired voltage may be charged in the storage capacitor Cst regardless of the voltage drop. The voltage value of the reference power supply Vref may vary with the data signal. For example, the voltage value may be the same as that of the first power supply ELVDD.

Figure 4:
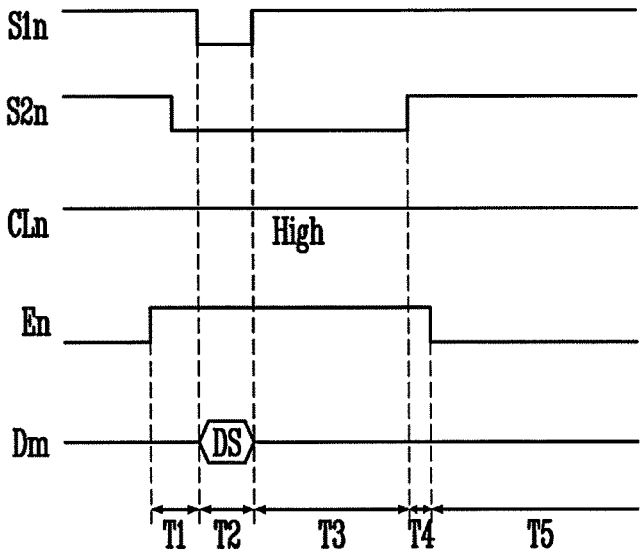
FIG. 4 is a view illustrating an embodiment of driving waveforms supplied to the pixel of FIG. 3 in a driving period.

FIG. 4 is a view illustrating an embodiment of driving waveforms supplied to the pixel of FIG. 3 in a driving period. Here, the driving period means a period in which the pixel is normally driven.

Referring to FIG. 4, first, in a first period T1, the emission control signal is supplied to the emission control line En. When the emission control signal is supplied to the emission control line En, the fifth transistor M5 and the sixth transistor M6 are turned off. When the fifth transistor M5 is turned off, the first power supply ELVDD and the second node N2 are electrically insulated from each other. When the sixth transistor M6 is turned off, the first transistor M1 and the OLED are electrically insulated from each other. Therefore, in the first to fourth periods T1 to T4 where the emission control signal is supplied to the emission control line En, the pixel 140 is set in a non-emission state.

After the emission control signal is supplied to the emission control line En, in a partial period of the first period T1, the second scan signal is supplied to the second scan line S2*n*. When the second scan signal is supplied to the second scan line S2*n*, the fourth transistor M4 is turned on. When the fourth transistor M4 is turned on, the voltage of the reference power supply Vref is supplied to the second node N2.

In a second period T2, the first scan signal is supplied to the first scan line S1*n* and the data signal DS is supplied to the data line Dm. When the first scan signal is supplied to the first scan line S1*n*, the third transistor M3 is turned on. When the third transistor M3 is turned on, the data signal from the data line Dm is supplied to the first node N1. At this time, the storage capacitor Cst charges the voltage corresponding to the difference voltage between the reference power supply Vref and the data signal. Here, since the voltage drop is not generated in the reference power supply Vref, the desired voltage may be charged in the storage capacitor Cst to correspond to the data signal.

Further, during the second period T2, when the data signal is supplied to the first node N1, the on bias voltage is applied to the first transistor M1. Actually, the first transistor M1 receives the on bias voltage from the point of time at which the data signal is supplied to the first node N1 to the point of time at which the supply of the second scan signal to the second scan line S2*n* is stopped, i.e., in the second period T2 and a third period T3. When the on bias voltage is supplied to the first transistor M1, the threshold voltage of the first transistor M1 is initialized to the on bias voltage. In this case, the first transistor M1 may control the amount of current supplied to the OLED so that an image with desired brightness may be displayed regardless of the data signal in a previous period.

On the other hand, on bias voltage supply time is controlled by the second scan signal supplied to the second scan line S2*n*. Therefore, according to the present embodiment, the second scan signal is supplied to the nth second scan line S2*n* to overlap the first scan signal supplied to the nth first scan line S1*n* and to have a larger width than that of the first scan signal. The emission control signal is supplied to the nth emission control line En to overlap the second scan signal supplied to the nth second scan line S2*n* and to have a larger width than that of the second scan signal so that unnecessary light is not generated by the pixel 140.

In a fourth period T4, the supply of the second scan signal to the second scan signal S2*n* is stopped. When the supply of the second scan signal to the second scan line S2*n* is stopped, the fourth transistor M4 is turned off so that electric coupling between the reference power supply Vref and the second node N2 is blocked.

In a fifth period T5, the supply of the emission control signal to the emission control line En is stopped. When the supply of the emission control signal to the emission control line En is stopped, the fifth transistor M5 and the sixth transistor M6 are turned on. When the fifth transistor M5 is turned on, the voltage of the first power supply ELVDD is supplied to the second node N2. At this time, since the first node N1 is floated, the storage capacitor Cst maintains the voltage charged in the previous period.

When the sixth transistor M6 is turned on, the first transistor M1 and the OLED are electrically coupled to each other. At this time, the first transistor M1 controls the amount of current that flows from the first power supply ELVDD to the second power supply ELVSS via the OLED to correspond to the voltage applied to the first node N1.

In practice, according to the present embodiment, the pixels 140 repeat the above-described processes in the driving period to realize a predetermined image. For example, the above-described processes may be sequentially performed in units of horizontal lines.

Figure 5:
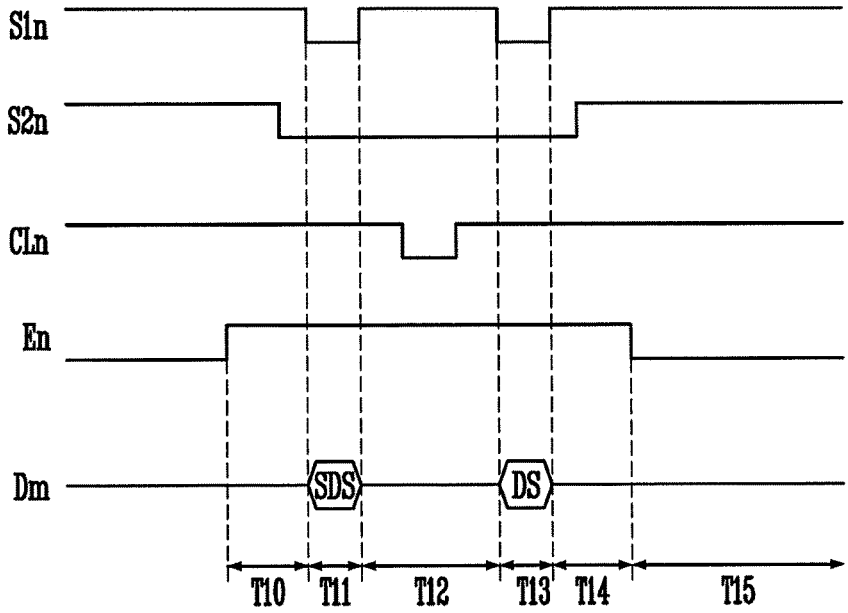
FIG. 5 is a view illustrating an embodiment of driving waveforms supplied in a second sensing period for sensing the threshold voltage of a driving transistor.

FIG. 5 is a view illustrating an embodiment of driving waveforms supplied in a second sensing period for sensing the threshold voltage of a driving transistor. In FIG. 5, the sensing data signal SDS and the data signal DS are continuously supplied so that information is extracted in real time. However, embodiments are not limited thereto. For example, in the second sensing period, only the sensing data signal SDS may be supplied to extract the threshold voltage of the driving transistor.

Referring to FIG. 5, first, in a tenth period T10, the emission control signal is supplied to the emission control line En. When the emission control signal is supplied to the emission control line En, the fifth transistor M5 and the sixth transistor M6 are turned off so that the pixel 140 is set to be in a non-emission state. After the emission control signal is supplied to the emission control line En, the second scan signal is supplied to the second scan line S2*n* within the tenth period T10 so that the fourth transistor M4 is turned on. When the fourth transistor M4 is turned on, the voltage of the reference power supply Vref is supplied to the second node N2.

In an $11^{th}$ period T11, the first scan signal is supplied to the first scan line S1*n* and the sensing data signal is supplied to the data line Dm. When the first scan signal is supplied to the first scan line S1*n*, the third transistor M3 is turned on. When the third transistor M3 is turned on, the sensing signal SDS from the data line Dm is supplied to the first node N1. At this time, the storage capacitor Cst charges the voltage corresponding to a difference between the reference power supply Vref and the sensing data signal SDS.

In a $12^{th}$ period T12, the control signal is supplied to the control line CLn. When the control signal is supplied to the control line CLn, the second transistor M2 is turned on. When the second transistor M2 is turned on, the feedback line Fm and the second electrode of the first transistor M1 are electrically coupled to each other. Then, predetermined current is supplied to the feedback line Fm via the first transistor M1 to correspond to the sensing data signal SDS. Here, the amount of current supplied from the first transistor M1 to the feedback line Fm is determined by the threshold voltage and mobility of the first transistor M1. That is, although the same sensing data signal SDS is supplied to all of the pixels 140, different currents flow in accordance with the threshold voltage and mobility of the first transistor M1. The sensing unit 170 extracts the threshold voltage information of the first transistor M1 to correspond to the amount of current supplied from the first transistor M1 and supplies the extracted information to the timing controller 150.

Then, in a $13^{th}$ period T13, the first scan signal is supplied to the first scan line S1*n* and the data signal DS is supplied in synchronization with the first scan signal. When the first scan signal is supplied to the first scan line S1*n*, the third transistor M3 is turned on so that the data signal DS from the data line Dm is supplied to the first node N1. At this time, the storage capacitor Cst charges the voltage corresponding to the difference between the data signal DS and the reference power supply Vref.

In a 14$^{th}$ period T14, the supply of the second scan signal to the second scan line S2*n* is stopped so that the fourth transistor M4 is turned off. In a 15th period T15, the supply of the emission control signal to the emission control line En is stopped so that the fifth transistor M5 and the sixth transistor M6 are turned on. At this time, the first transistor M1 controls the amount of current that flows from the first power supply ELVDD to the second power supply ELVSS via the OLED to correspond to the voltage applied to the first node N1.

In practice, according to the present embodiment, the pixels 140 repeat the above-described processes in the second sensing period to sense the threshold voltage of each driving transistor. For example, the above-described processes may be sequentially performed in units of horizontal lines.

Figure 6:
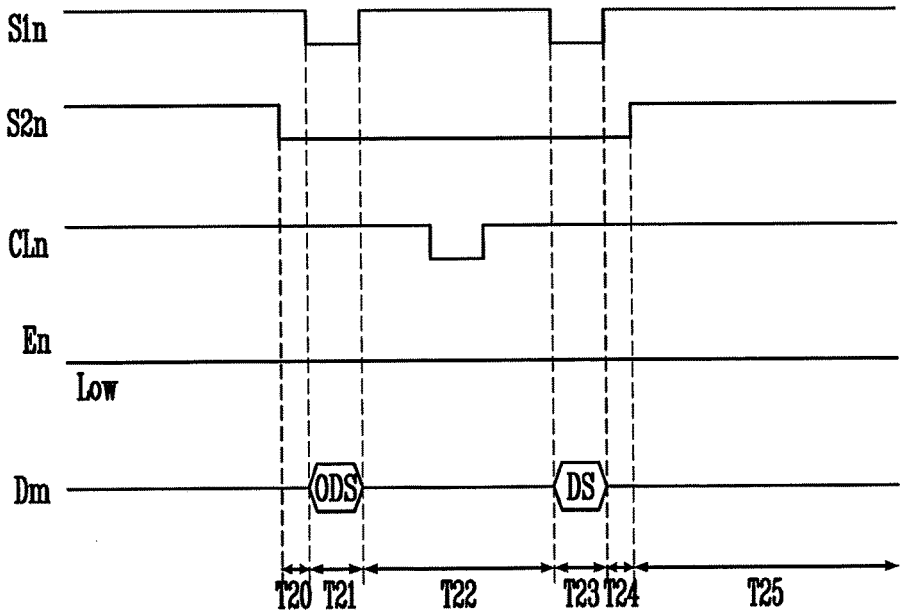
FIG. 6 is a view illustrating an embodiment of driving waveforms supplied in a first sensing period for sensing deterioration information of an OLED.

FIG. 6 is a view illustrating an embodiment of driving waveforms supplied in a first sensing period for sensing deterioration information of an OLED. In FIG. 6, the off data signal ODS and the data signal DS are continuously supplied so that information is extracted in real time. However, embodiments are not limited thereto. For example, in the first sensing period, only the off data signal ODS may be supplied so that only the deterioration information of the OLED may be extracted.

Referring to FIG. 6, first, in a 20$^{th}$ period, the second scan signal is supplied to the second scan line S2*n*. When the second scan signal is supplied to the second scan line S2*n*, the fourth transistor M4 is turned on so that the voltage of the reference power supply Vref is supplied to the second node N2. Here, in the first sensing period, since the emission control signal is not supplied to the emission control line En, the fifth transistor M5 and the sixth transistor M6 maintain a turn-on state. Therefore, in the 20$^{th}$ period T20, the voltages of the reference power supply Vref and the first power supply ELVDD may be simultaneously supplied to the second node N2. Assuming that the voltages of the reference power supply Vref and the first power supply ELVDD are the same, the voltages may be stably applied to the second node N2. In addition, although the voltage of the first power supply ELVDD is reduced by the voltage drop, the second node N2 maintains the voltage of the reference power supply Vref by the reference power supply Vref. Therefore, the desired voltage may be charged in the storage capacitor Cst.

In a 21$^{st}$ period t21, the first scan signal is supplied to the first scan line S1*n* and the off data signal ODS is supplied to the data line Dm. When the first scan signal is supplied to the first scan line S1*n*, the third transistor M3 is turned on. When the third transistor M3 is turned on, the off data signal ODS from the data line Dm is supplied to the first node N1. Here, the off data signal ODS is set to have a voltage at which the first transistor M1 may be turned off.

In a 22$^{nd}$ period T22, the control signal is supplied to the control line CLn. When the control signal is supplied to the control line CLn, the second transistor M2 is turned on. When the second transistor M2 is turned on, the feedback line Fm and the anode electrode of the OLED are electrically coupled to each other. Then, in the 22$^{nd}$ period T22, predetermined current is supplied from the sensing unit 170 to the feedback line Fm. The predetermined current supplied to the feedback line Fm is supplied to the OLED so that a predetermined voltage is applied to the OLED. Here, the resistance value of the OLED changes to correspond to deterioration. Therefore, the voltage applied to the OLED to correspond to the predetermined current includes the deterioration information of the OLED. The sensing unit 170 extracts the deterioration information using the predetermined voltage applied to the OLED and supplies the extracted deterioration information to the timing controller 150.

Then, in a 23$^{rd}$ period T23, the first scan signal is supplied to the first scan line S1*n* and the data signal DS is supplied in synchronization with the first scan signal. When the first scan signal is supplied to the first scan line S1*n*, the third transistor M3 is turned on so that the data signal DS from the data line Dm is supplied to the first node N1. At this time, the storage capacitor Cst charges the voltage corresponding to the difference between the data signal DS and the reference power supply Vref.

In a 24$^{th}$ period T24, the supply of the second scan signal to the second scan line S2*n* is stopped so that the fourth transistor M4 is turned off. In a 25$^{th}$ period T25, the supply of the emission control signal to the emission control line En is stopped so that the fifth transistor M5 and the sixth transistor M6 are turned on. At this time, the first transistor M1 controls the amount of current that flows from the first power supply ELVDD to the second power supply ELVSS via the OLED to correspond to the voltage applied to the first node N1.

In practice, according to the present embodiment, the pixels 140 repeat the above-described processes in the first sensing period to sense deterioration information of each OLED. For example, the above-described processes may be sequentially performed in units of horizontal lines.

According to the present embodiment, the driving period, the first sensing period, and the second sensing period are appropriately arranged in units of frames. For example, the pixels may be driven by waveforms of the driving period in most frames and may be driven by waveforms of the first sensing period and the second sensing period in specific frames. Then, in the specific frames, the deterioration information of the OLEDs and the threshold voltage information of the driving transistors are extracted. Then, the timing controller 150 changes the first data data1 so that the deterioration of the OLEDs included in the pixels 140 and the threshold voltages of the driving transistors included in the pixels 140 may be compensated for using the deterioration information and the threshold voltage information to generate the second data data2. Therefore, in the driving period, the pixels 140 may realize an image with uniform brightness regardless of the deterioration of the OLEDs.

Figure 7:
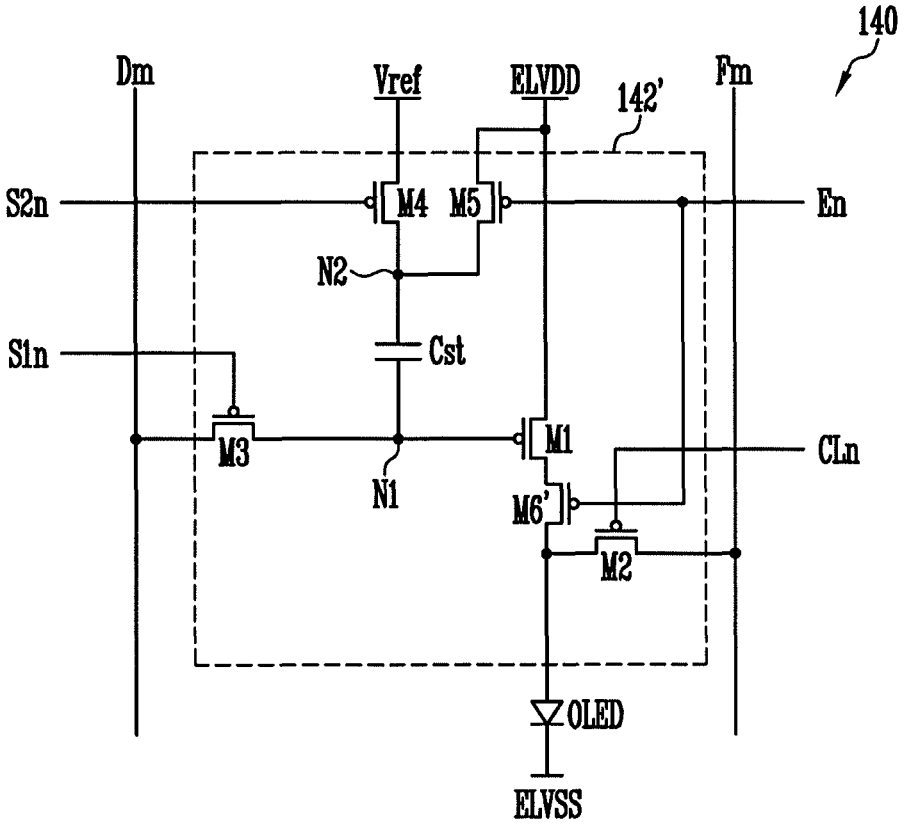
FIG. 7 is a view illustrating a pixel according to a second embodiment.

FIG. 7 is a view illustrating a pixel according to a second embodiment. Referring to FIG. 7, the pixel 140 according to the second embodiment includes an OLED and a pixel circuit 142' for controlling the amount of current supplied to the OLED. The pixel circuit 142' in FIG. 7 is the same as that of FIG. 3, except for a position of a sixth transistor M6'. Therefore, In FIG. 7, like reference numerals refer to like elements and description of the elements will be omitted.

The sixth transistor M6' included in the pixel circuit 142' is coupled between the common node of the second transistor M2 and the OLED, and the second electrode of the first transistor M1. The sixth transistor M6' is turned off when the emission control signal is supplied to the emission control line En and is otherwise turned on.

The pixel according to the second embodiment is driven by the driving waveforms of FIG. 4. Thus, description thereof will be omitted.

Figure 8:
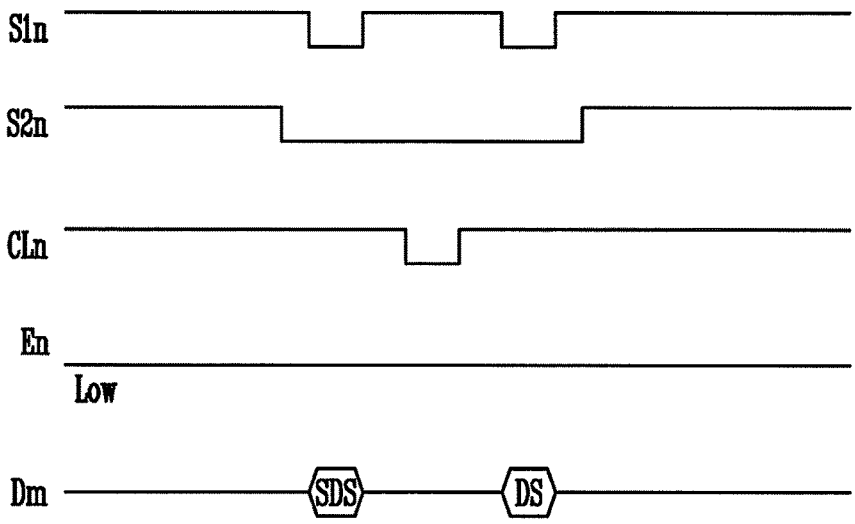
FIG. 8 is a view illustrating an embodiment of driving waveforms supplied to the pixel of FIG. 7 in the second sensing period.

FIG. 8 is a view illustrating an embodiment of driving waveforms supplied to the pixel of FIG. 7 in the second sensing period. In describing FIG. 8, description of the same driving waveforms of FIG. 5 will be omitted.

Referring to FIG. 8, in the second sensing period, the emission control signal is not supplied to the emission control line En. In this case, in the second sensing period, the fifth transistor M5 and the sixth transistor M6' maintain a turn-on state. When the fifth transistor M5 maintains a turn-on state, in a partial period, the voltages of the reference power supply Vref and the first power supply ELVDD may be simultaneously supplied to the second node N2. Assuming that the voltages of the reference power supply Vref and the first power supply ELVDD are the same, the voltages may be stably applied to the second node N2. In addition, although the voltage of the first power supply ELVDD is reduced by the voltage drop, the second node N2 maintains the voltage of the reference power supply Vref by the reference power supply Vref. Therefore, the desired voltage may be charged in the storage capacitor Cst.

In addition, when the sixth transistor M6' is turned on, in a period where the second transistor M2 is turned on, the first transistor M1 and the feedback line Fm are electrically coupled to each other. That is, the current corresponding to the sensing data signal SDS may be stably supplied from the first transistor M1 to the feedback line Fm via the sixth transistor M6' and the second transistor M2. Here, in order to improve reliability of the operation, in a period where the control signal is supplied to the control line CLn, the voltage of the second power supply ELVSS may be increased so that the current does not flow to the OLED.

Figure 9:
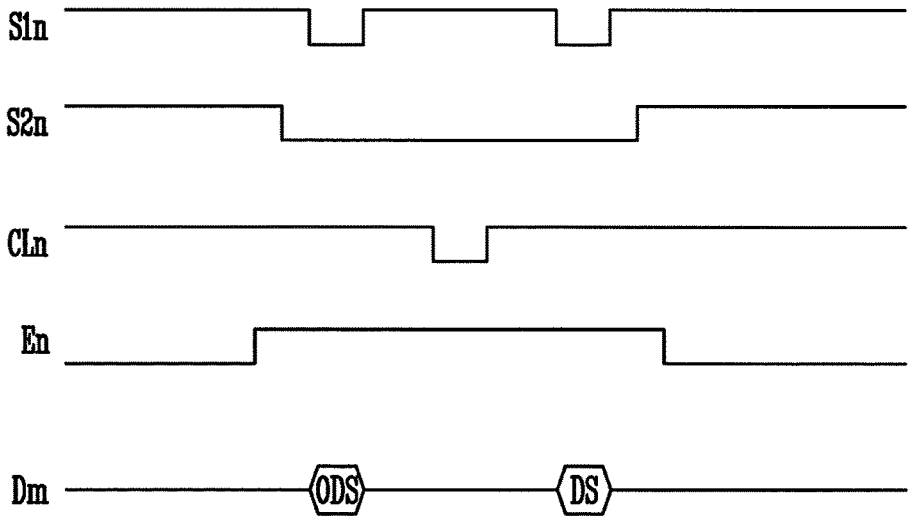
FIG. 9 is a view illustrating an embodiment of driving waveforms supplied to the pixel of FIG. 7 in the first sensing period.

FIG. 9 is a view illustrating an embodiment of driving waveforms supplied to the pixel of FIG. 7 in the first sensing period. In describing FIG. 9, description of the same driving waveforms of FIG. 6 will be omitted.

Referring to FIG. 9, in the first sensing period, the emission control signal is supplied to the emission control line En. When the emission control signal is supplied to the emission control line En, the fifth transistor M5 and the sixth transistor M6' are set to be in a turn-off state. When the sixth transistor M6' is turned off, the first transistor M1 and the second transistor M2 are electrically insulated from each other.

Therefore, in the case of the waveforms of FIG. 9, a process of supplying the off data signal ODS to the data line Dm may be omitted. When the control signal is supplied to the control line CLn, the second transistor M2 is turned on so that the feedback line Fm and the anode electrode of the OLED are electrically coupled to each other. At this time, a predetermined voltage is applied to the OLED to correspond to the current supplied from the sensing unit 170 and the deterioration information of the OLED is extracted using the predetermined voltage.

By way of summation and review, the pixel according to embodiments and the organic light emitting display using the same, an on bias voltage is applied to the driving transistor before a data signal is supplied so that the characteristic of the driving transistor is initialized. In this case, the driving transistor may supply desired current to the OLED regardless of the data signal of a previous period so that an image with uniform brightness may be displayed. In addition, according to embodiments, the deterioration information of the OLED and the threshold voltage information of the driving transistor are extracted, at least in specific frames, and data is changed to correspond to the extracted information so that an image with uniform brightness may be displayed.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A pixel, comprising:

an organic light emitting diode (OLED);

a first transistor for controlling an amount of current that flows from a first power supply to a second power supply via the OLED to correspond to a voltage applied to a first node;

a second transistor coupled between an anode electrode of the OLED and a feedback line, the second transistor having a gate electrode coupled to a control line;

a third transistor coupled between the first node and a data line, the third transistor having a gate electrode coupled to a first scan line that supplies a first scan signal to the third transistor;

a storage capacitor coupled between the first node and a second node; and a fourth transistor coupled between the second node and a reference power supply, the fourth transistor having a gate electrode coupled to a second scan line that supplies a second scan signal to the fourth transistor, wherein the first scan signal has a width different from that of the second scan signal, and wherein the third transistor is turned on by the first scan signal in a partial period of a period in which the fourth transistor is turned on by the second scan signal, the partial period being shorter than the period in which the fourth transistor is turned on by the second scan signal.

2. The pixel as claimed in claim 1, wherein the second transistor is turned on so that a turn-on period thereof overlaps that of the fourth transistor in a specific frame period of a plurality of frames.

3. The pixel as claimed in claim 2, wherein the turn-on period of the second transistor does not overlap that of the third transistor.

4. The pixel as claimed in claim 1, further comprising:

a fifth transistor coupled between the first power supply and the second node, the fifth transistor having a gate electrode coupled to an emission control line; and a sixth transistor coupled between a common terminal of the second transistor and the first transistor and the anode electrode of the OLED, the sixth transistor having a gate electrode coupled to the emission control line.

5. The pixel as claimed in claim 4, wherein a turn-on period of the fifth transistor does not overlap that of the fourth transistor in a remaining frame period excluding a frame in which deterioration information of the OLED is extracted among a plurality of frames.

6. The pixel as claimed in claim 1, further comprising:

a fifth transistor coupled between the first power supply and the second node, the fifth transistor having a gate electrode coupled to an emission control line; and a sixth transistor coupled between a common terminal of the second transistor and the anode electrode of the OLED, and the first transistor, the sixth transistor having a gate electrode coupled to the emission control line.

7. The pixel as claimed in claim 6, wherein a turn-on period of the fifth transistor does not overlap that of the fourth transistor in a remaining frame period excluding a frame in which threshold voltage information of the first transistor is extracted among a plurality of frames.

8. An organic light emitting display, comprising:

a scan driver for driving first scan lines, second scan lines, and emission control lines;

a control line driver for driving control lines;

a data driver for driving data lines;

pixels positioned at intersections of the first scan lines and the data lines;

a sensing unit for extracting deterioration information of OLEDs included in the pixels in a first frame period of a plurality of frames and for extracting threshold voltage information of driving transistors included in the pixels in a second frame period; and a timing controller for changing bits of first data items to correspond to the deterioration information and the threshold voltage information to generate second data items, wherein the data driver supplies off data signals to the pixels through the data lines in the first frame period, supplies sensing data signals to the pixels through the data lines in the second frame period, and supplies data signals corresponding to the second data items to the data lines in remaining frames excluding the first frame period and the second frame period, and wherein the off data signals are set such that the driving transistors are turned off during the first frame period in which the deterioration information of the OLEDs is extracted by the sensing unit.

9. The organic light emitting display as claimed in claim 8, wherein the sensing data signals are set so that predetermined currents may flow from the driving transistors.

10. The organic light emitting display as claimed in claim 8, wherein the sensing unit supplies predetermined current to the feedback line in the first frame period to extract the deterioration information of the OLEDs and to extract the threshold voltage information of the driving transistors to correspond to amounts of currents supplied from the pixels to correspond to the sensing data signals in the second frame period.

11. The organic light emitting display as claimed in claim 8, wherein each of the pixels positioned in an ith horizontal line comprises:

an OLED;

a driving transistor for controlling an amount of current that flows from a first power supply to a second power supply via the OLED to correspond to a voltage applied to a first node;

a second transistor coupled between an anode electrode of the OLED and a feedback line, the second transistor being turned on when a control signal is supplied to an ith control line;

a third transistor coupled between the first node and a data line, the third transistor being turned on when a first scan signal is supplied to an ith first scan line;

a storage capacitor coupled between the first node and a second node; and a fourth transistor coupled between the second node and a reference power supply, the fourth transistor being turned on when a second scan signal is supplied to an ith second scan line, wherein the third transistor is turned on by the ith first scan signal in a partial period of a period in which the fourth transistor is turned on by the ith second scan signal, the partial period being shorter than the period in which the fourth transistor is turned on by the ith second scan signal.

12. The organic light emitting display as claimed in claim 11, wherein the scan driver supplies a second scan signal to an ith second scan line to overlap a first scan signal supplied to an ith first scan line, the second scan signal having a larger width than the first scan signal.

13. The organic light emitting display as claimed in claim 12, wherein the control line driver supplies a control signal to an ith control line to overlap the second scan signal supplied to the ith second scan line in the first frame period and the second frame period.

14. The organic light emitting display as claimed in claim 13, wherein the first scan signal supplied to the ith first scan line does not overlap the control signal supplied to the ith control line.

15. The organic light emitting display as claimed in claim 11, wherein each of the pixels positioned in the ith horizontal line further comprises:

a fifth transistor coupled between the first power supply and the second node, the fifth transistor being turned off when an emission control signal is supplied to an ith emission control line and otherwise being turned on; and a sixth transistor coupled between a common terminal of the second transistor and the driving transistor and the anode electrode of the OLED, the sixth transistor being simultaneously turned on and off with the fifth transistor.

16. The organic light emitting display as claimed in claim 15, wherein the scan driver supplies an emission control signal to an ith emission control line to overlap the second scan signal supplied to the ith second scan line in a remaining period excluding the first frame period.

17. The organic light emitting display as claimed in claim 11, wherein each of the pixels positioned in the ith horizontal line further comprises:

a fifth transistor coupled between the first power supply and the second node, the fifth transistor being turned off when an emission control signal is supplied to an ith emission control line and otherwise being turned on; and a sixth transistor coupled between a common terminal of the second transistor and the anode electrode of the OLED and the driving transistor, the sixth transistor being simultaneously turned on and off with the fifth transistor.

18. The organic light emitting display as claimed in claim 17, wherein the scan driver supplies an emission control signal to an ith emission control line to overlap the second scan signal supplied to the ith second scan line in a remaining period excluding the second frame period.

* * * * *